US005251709A

United States Patent [19]

Richardson

[11] Patent Number: 5,251,709

[45] Date of Patent: Oct. 12, 1993

[54] DRILLING RIG

[76] Inventor: Allan S. Richardson, 1165G - 44th Avenue, SE. Calgary, Alberta, Canada, T2G 4X4

[21] Appl. No.: 861,127

[22] Filed: Mar. 31, 1992

Related U.S. Application Data

[63] Continuation-in-part of Ser. No. 474,981, Feb. 6, 1990, abandoned.

[51] Int. Cl.[5] ..... E21B 15/00; E21B 3/02

[52] U.S. Cl. ..... 175/220; 175/85; 175/162

[58] Field of Search ..... 175/85, 220, 162; 173/28, 163, 164

[56] References Cited

U.S. PATENT DOCUMENTS

| | | | |
|---|---|---|---|
| 1,375,092 | 4/1921 | Hanson | 175/220 X |
| 1,395,706 | 11/1921 | Greve | 175/214 X |
| 2,979,143 | 4/1961 | Kandle | 173/28 X |
| 2,998,084 | 8/1961 | Johnson et al. | 175/214 X |
| 3,857,450 | 12/1974 | Guier | 175/85 |
| 3,915,244 | 10/1975 | Brown | 175/85 |
| 4,126,193 | 11/1978 | Brown et al. | 173/28 X |
| 4,421,179 | 12/1983 | Boyadjieff | 175/85 X |
| 4,610,315 | 9/1986 | Koga et al. | 175/85 |
| 4,625,796 | 12/1986 | Boyadjieff | 175/85 X |
| 4,815,546 | 3/1989 | Haney et al. | 173/163 X |
| 4,865,135 | 9/1989 | Moses | 175/170 X |

*Primary Examiner*—Hoang C. Dang
*Attorney, Agent, or Firm*—Zarley, McKee, Thomte, Voorhees, & Sease

[57] ABSTRACT

The present invention discloses structures which enable the construction or conversion of drilling rigs in which the rotary table and kelly are replaced by a top drive rotating mechanism. Furthermore, torque guide is provided to control lateral movement of the top drive and resist reactionary rotational forces induced by the top drive, without applying additional forces to the mast of the rig.

17 Claims, 6 Drawing Sheets

DRILLING RIG

This application is a continuation-in-part of application Ser. No. 07/474,981, filed Feb. 6, 1990, now abandoned.

This invention relates to improvements in drilling rigs of the type used for drilling oil wells and the like.

In particular, it relates to means designed to allow the construction of new rigs or the conversion of existing conventional rigs to the use of top drive technology and its advantages.

For many years conventional drilling rigs were all substantialy similar and comprised a number of basic functional features which they all had in common. These include:

(a) a mast,
(b) a crown block mounted at the ton of the mast,
(c) a travelling block suspended to move vertically within the mast,
(d) a cable drum to hoist and lower the travelling block,
(e) means on the travelling block to support, hoist or lower, lengths of drill pipe or production pipe or the entire drill string or production string, and
(f) a rotary table designed to rotate a kelly of square cross section connected to the top of the drill string to facilitate drilling.

During drilling, the drill string and the bit at the lower end thereof are turned by means of the rotary table which has a square or hexagonal cross sectional opening to receive a kelly (which is a forty foot length of pipe with a similar cross section at the top of the drill string) which is connected to a swivel and mud line to facilitate circulation of fluids and remove cuttings. The drill string is partially supported at the swivel to reduce the weight on the bit to a desirable level.

When the bit advances a full length of the kelly, the drill string is lifted until the kelly is out of the rotary table. The topmost length of pipe is suspended by slips in the table and the kelly is disconnected so that a new length of pipe can be added. The kelly is reconnected and the bit is returned to the bottom of the hole to resume drilling.

When a new bit is required (or other operational change is necessary), the drill pipe has to be tripped out of the hole. In this operation the procedure is to lift and disconnect the kelly and put it to one side in a "rat hole". The travelling block is fastened to the ton of the drill string by means of elevators suspended from the travelling block and the drill string is raised out of the hole, one stand or three lengths of pipe at a time and placed in a rack or monkey board in the mast of the rig. When the new bit has been installed the string is tripped back in the hole using the blocks to lower the string and fastening each stand in order. The kelly is replaced and the rotary table is restarted to commence drilling.

In recent years the trend has been to replace the rotary table and kelly arrangement with machinery known as a "top drive". Whereas a rotary table is a gear driven platform designed to rotate on the derrick floor a top drive is a power unit energized by a motor (usually electric) and designed to rotate, by means of reduction gears, a quill connected by threads to the top or box end of the drill pipe string. This power unit travels up and down within the mast at the top of the drill string as the drilling advances or the pipe is raised.

The advantages of this arrangement are that:

(a) The operator can drill a full ninety foot stand continuously rather than a thirty foot length as with the kelly,
(b) The top drive can be used to spin in the threaded connection of a stand or joint, and
(c) The drill string can be rotated to ream the hole while running in or out, or while circulating fluids during raising or lowering the string.

These advantages have led to not only the construction of new rigs but the desire to convert existing rigs to top drive technology and systems.

This has been done in some cases but because of problems associated with this different arrangement they have generally been restricted to large offshore rigs. The top drive equipment, together with the pipe handling equipment all suspended by the travelling block have required too much head room and were therefore only adaptable to very high masts. Furthermore, in order to apply torque to the top of the drill string the top drive must be mounted in some way so that it may run up and down the mast and yet still resist the reactionary forces which result from the torque applied to the drill string. In one case this latter problem has been solved by mounting the top drive on a set of tracks fastened to the struts of the mast as illustrated in U.S. Pat. No. 4,421,179.

While this solution works on heavy, structurally strong masts such as those found on offshore drilling rigs, it presents a problem for small land type rigs, especially modern lighter more mobile rigs, because the top drive restraint puts reactionary torsional forces on the mast which most rigs are not designed to handle.

The present invention is designed to provide means by which drilling rigs, especially those of the smaller lighter land type, may be constructed or converted to use top drive mechanisms. By means of the preferred emodiment of the present invention a typical rig, having a total of approximately one hundred and twenty-seven feet of head room from floor to crown, may be constructed or converted to use top drive technology without adding extra lateral or torsional loads to the mast, and without providing additional structure which clutters up the work area within the mast.

These and other advantages may be accomplished by providing a drilling rig comprising a mast, crown and travelling blocks, with means to move same, a top drive, means to mount said top drive comprising a torque guide mounted on the rig base and extending vertically up the inside of the mast, and designed to restrain lateral movement and torsional moment, and carriage means adapted to transmit rotational resistance between said torque guide and said top drive and to allow said top drive to move vertically within the mast, whereby the torque guide provides resistance to lateral and rotational movement of the top drive without applying substantial forces to the mast.

Preferably, the torque guide has a relatively wide lateral dimension to provide substantial resistance to torsional forces and permitting very little movement of the top drive under normal tolerance.

The foregoing advantages are also facilitated by providing a top drive mechanism which is mounted directly to the travelling block without the conventional hook and having an internal floating quill adapted to accommodate the vertical travel of a drill pipe during make up and in which a top drive is used to make up joints of pipe with only a hydraulic back up wrench rather than a separate torque wrench.

The nature of the invention can best be understood by a description of one emodiment thereof with reference to the drawings in which, FIG. 1 is a perspective view of a conventional drilling rig;

Figure 1:
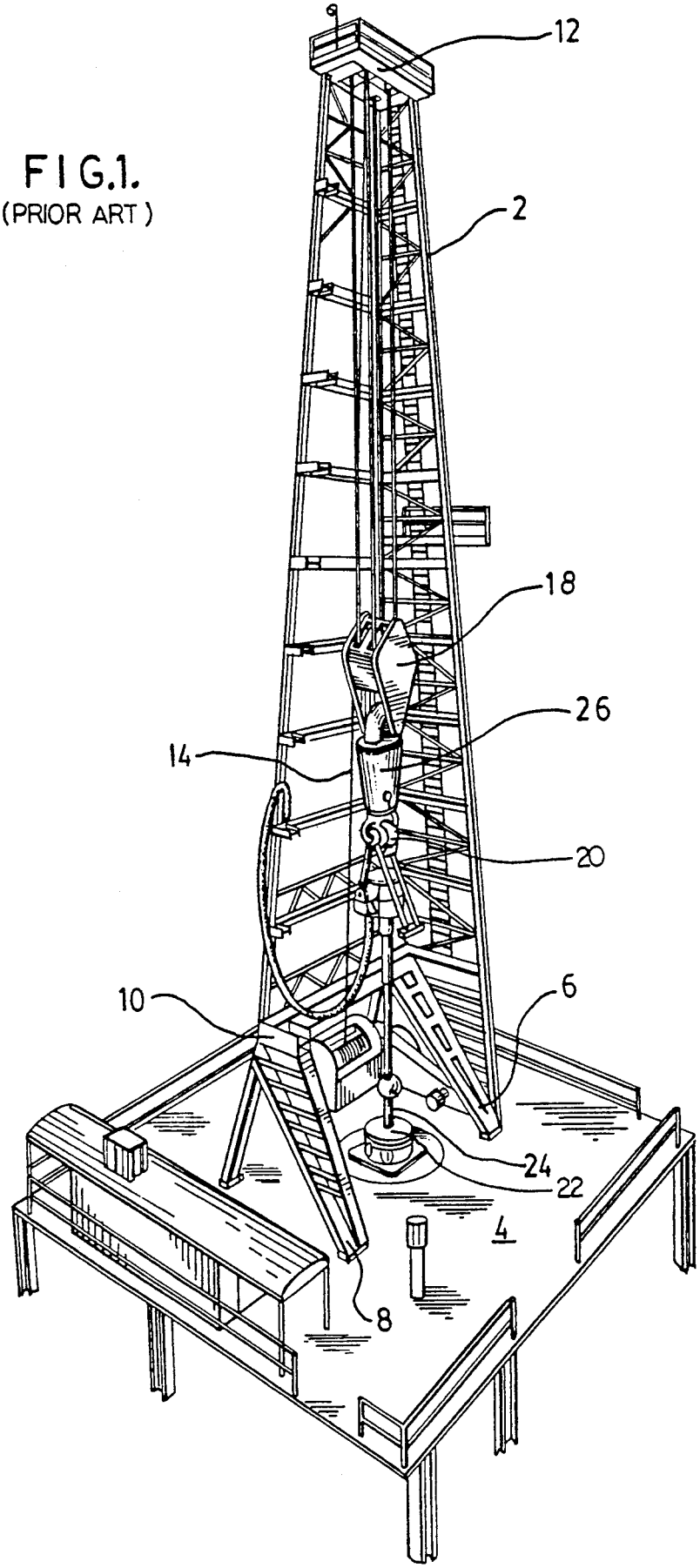
FIG.1. (PRIOR ART)
FIG. 1 illustrates a typical conventional drilling rig having a mast 2 supported on the derrick floor 4 by an A Frame 6 by means of a pivotal mounting at 8 and a releasable fastening means at 10.

The mast supports a crown block and sheave at 12 over which pass loops of a cable 14 from the drum of 16 of the draw works. Several loons of the cable over the crown block support the travelling block 18 from which is suspended a hook 20 which is used to support the elevators, swivel and mud line, all attached to the kelly joint at the top of the drill string.

The travelling block and hook are used to lift any equipment needed in the operation and to support the weight of the drill string and adjust the weight on the bit at the bottom of the hole. When not drilling they are used to lift the drill string out of the hole in order to replace the bit and lower it in again (procedures known as "tripping out" and "tripping in"). On the floor of the rig is a rotary table 22 through which masses the drill string. During drilling the upper joint of the drill string is a kelly 24, which is a 40' length of pipe having a non-circular (usually square) cross-section which engages the non-circular opening of the rotary table so that when the rotary table is rotated by means of gears from the primary power source, the drill string and the bit are rotated but the kelly is permitted to slide down through the rotary table as the bit advances.

When the bit has to be replaced the string is lifted, the kelly is removed and stored (with the swivel and mud line attached) in the rat hole. The drill string is then removed by means of the elevators which fasten beneath the enlarged collar of the drill pipe and by means of the travelling block raise the string, usually three lengths of pipe at a time. The string is suspended by slips in the rotary table while tongs on the drill rig floor are used to break the threaded connections at the bottom of a three joint stand and the stand is placed in a rack known as a monkey board at the side of the mast. The reverse process is used to return the bit and the drill string to the hole.

Figure 3:
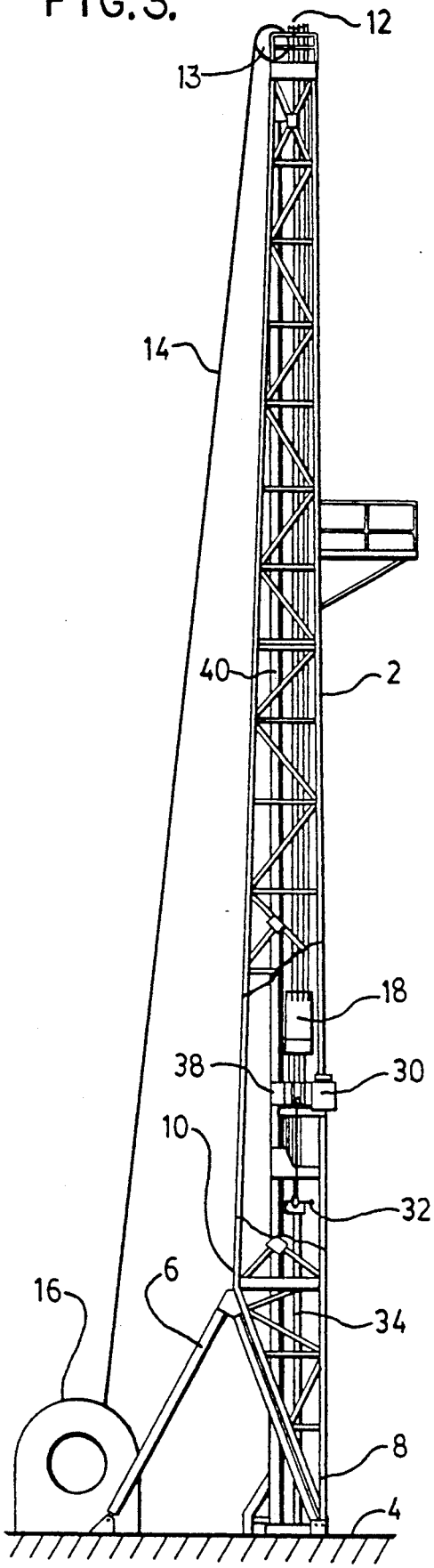
FIG. 3 is a side elevation view of the rig shown in FIG. 2.
Figure 2:
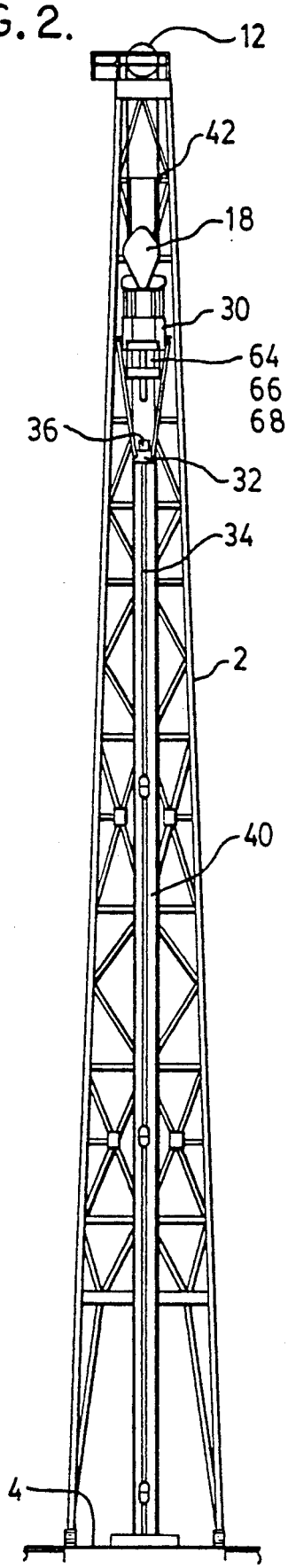
FIG. 2 is a front elevation of a drilling rig constructed or converted in accordance with the present invention.

FIG. 2 and FIG. 3 are front and side elevations of a modified drilling rig constructed or modified in accordance with the present invention in which the rotary table is eliminated in favour of a top drive, which is supported by the travelling block but restrained from lateral or torsional movement by a torque guide.

In FIGS. 2 and 3, as in FIG. 1, the mast 2 is mounted on the derrick floor 4 by means of an A Frame 6 to which it is pivotally mounted at 8 and releasably connected at 10 to allow the mast to be lowered for transport and raised for operations. Similarly a crown block at 12 is mounted at the top of the mast and a sheave 13 is provided to guide the cable 14 which is wound or unwound from the drum 16 of the draw works. The travelling block 18 is shown in the upper position in FIG. 2 and in a lowered position in FIG. 3.

Because of the modified version of this rig, the hook 20, rotary table 22 and the kelly 24 are eliminated.

In their place is a top drive mechanism shown generally at 30 suspended below the travelling block, the details of which will be described later with reference to more detailed drawings. Also suspended below the top drive are the elevators 32 which are conventional means for latching on to the raised diameter box end 36 of the drill pipe 34.

The top drive assembly is mounted for vertical movement but lateral restraint by means of a carriage 38 which is mounted to ride vertically along the torque guide 40. In the illustrated embodiment the torque guide 40 is shown mounted at the derrick floor and runs vertically up the inside of the mast rearward of the centre line of the hole and behind the drill string. This configuration contemplates that the torque guide will receive its torsional stability from the rig floor. However, it could be mounted to the base of the rig by attaching it to strong structural members, such as the sub-structure beneath the derrick floor, or the A frame, or at the bottom of the mast which is relatively strong.

The torque guide 40 terminates at a position below the crown block and is shown in the drawings fastened by struts 42 to the mast near the top. It may also be fastened to the mast at various intermediate intervals not shown.

Although the torque guide is fastened to the mast, it should be understood that it is constructed, in accordance with this invention, to be sufficiently strong and rigid to resist the applied reactionary forces without assistance from the structure of the mast. In fact since the maximum forces on the mast are generally applied during the raising of the mast into position, it is one advantage of the torque guide that it can provide additional strength to the mast during that procedure. Thus, while the mast may be used to locate and keep the torque guide straight and upright, it need not be designed or modified to absorb the substantial torsional forces induced by a top drive. These are resisted and absorbed by the torsional strength of the torque guide alone.

As in conventional rigs, the drill string is raised or lowered by the travelling block and the elevators 32 as seen in FIGS. 2 and 3.

Figure 4:
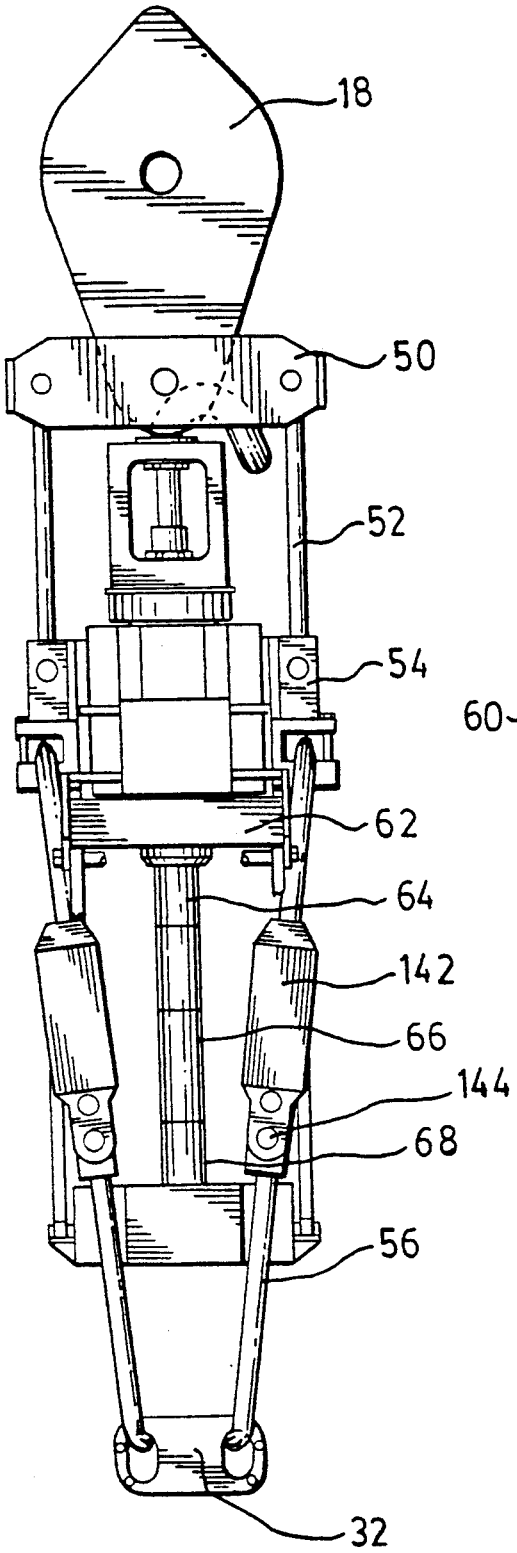
FIG. 4 is a front elevation view of the top drive.
Figure 5:
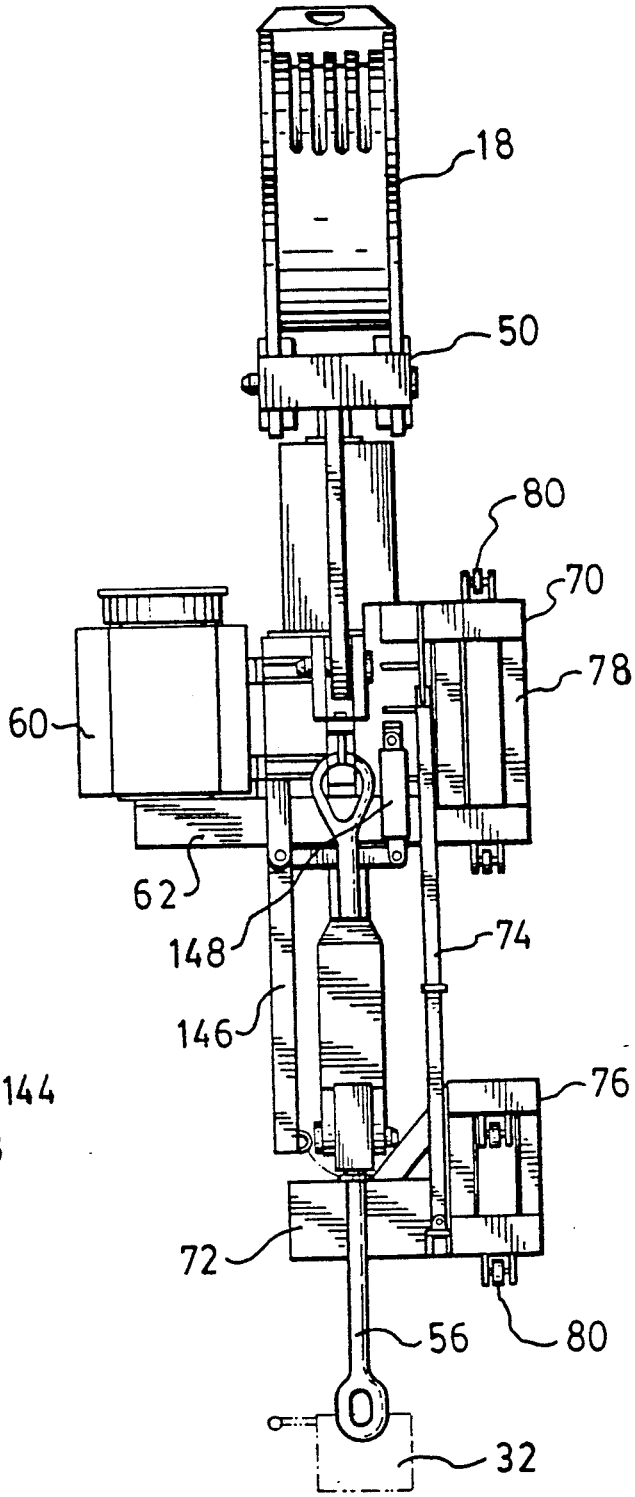
FIG. 5 is a side elevation of the top drive mechanism.

FIGS. 4 and 5 are front elevations and side elevations respectively showing in greater detail the top drive assembly.

The travelling block 18 is fitted with a block adapter 50 which supports a pair of hangers 52, connected to support lugs 54 from which the elevator links are suspended which in turn support the elevators 32 constructed to open and latch over the top end of the drill string.

Also supported on the support lugs 54 is the drive mechanism of the top drive comprising a motor, ideally a DC traction motor 60, (although it could be AC electric or hydraulic) which is adapted by a system of gears located in the gear case 62 to rotationally drive the spindle (which will be described in greater detail later) , and the quill 64 which is connected by a kelly cock 66 and saver sub 68 to the top of the drill string 34.

To maintain lateral control over the top drive, the assembly is mounted to an upper carriage 70, (indicated generally at 38 in FIG. 3) which is designed to run vertically along the length of the torque guide with horizontal restraint so as to keep the top drive from lateral movement or rotation under reactionary forces, when torque is applied.

Lower down, a hydraulic back up wrench 72 is suspended by positioning cylinders 74 which are designed to control and adjust the height of the back up wrench relative to the top drive and upper carriage. The hydraulic back up wrench is mounted to a lower carriage 76 which is designed, like the upper carriage, to move vertically along the torque guide but restrains the back up wrench from lateral or rotational movement.

The hydraulic back up wrench 72 is designed to provide resistance to the rotational movement of the drill string when the top drive motor and spindle are used to "make up" or "back off" the threaded joints of the drill pipe.

In the view illustrated in FIG. 5 the carriage is mounted to run along the torque guide by means of guide runners 78 which have bearing surfaces made of a resilient synthetic material such as ultra-high molecular weight polyethylene. These guide runners are designed to restrain forward-rearward movement. The lower carriage has a similar set of guide runners and rollers.

Figure 6:
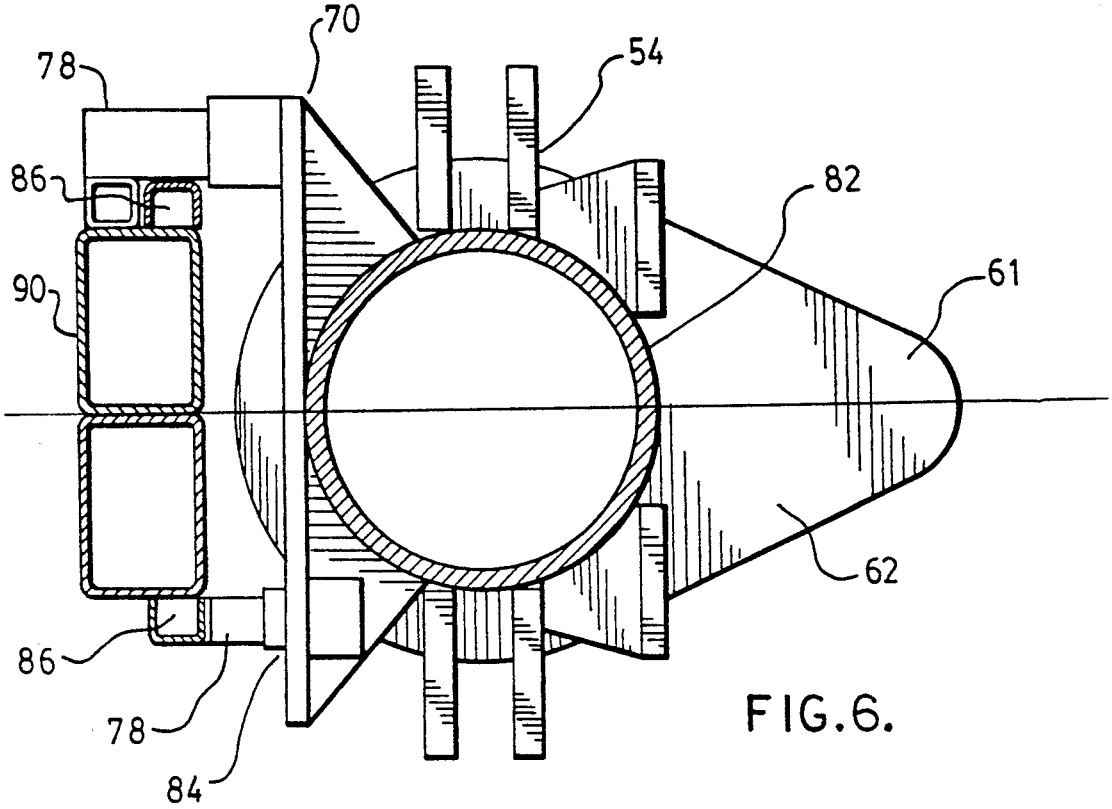
FIG. 6 is a plan view-of a top drive with carriage and torque guide as employed in FIGS. 2 and 3.

FIG. 6 illustrates in plan view a horizontal cross-section of the top drive in which the traction motor is shown at 61 and the position of the gear case 62 is shown. The spindle housing 82 is concentric with the centre line of the well and the upper carriage 70 fastened to the spindle housing is mounted by horizontally adjustable means 84 to the guide runners 78.

The guide runners run along the front and rear surfaces respectively of the tracks 86 mounted on the vertical side faces of the torque guide 90 (also referred to as 40 in the less detailed drawings of FIGS. 1, 2 and 3).

In this illustrated embodiment the torque guide 90 is composed of a pair of prefabricated steel members of rectangular cross-section. A typical such structure would be composed of a pair of 12 ins.×8 ins. rectangular sections with a wall thickness of approximately 0.5 ins. While the exact specifications will be dependent on the design of the rig and the torque drive in question, it is considered important that the torque guide have a substantial lateral dimension (in the order of approximately 24 ins.×8 ins.) so that the runners 78 are spaced apart in the same order of magnitude as the distance from the torque guide tracks to the centre of the drill hole or drill string. These substantial cross-sectional dimensions, as well as the strength of a closed section member in carrying torsion, provide a superior restraint to torsional reactionary forces of the top drive and will also minimize the amount of movement or play experienced by the top drive for any given amount of tolerance or gap between the guide runners and the track 86. In other words the twisting movement or torsional deflection under load of the torque guide will be minimized and the sloppiness of the mounting which controls the position of the top drive will be reduced.

Figure 7:
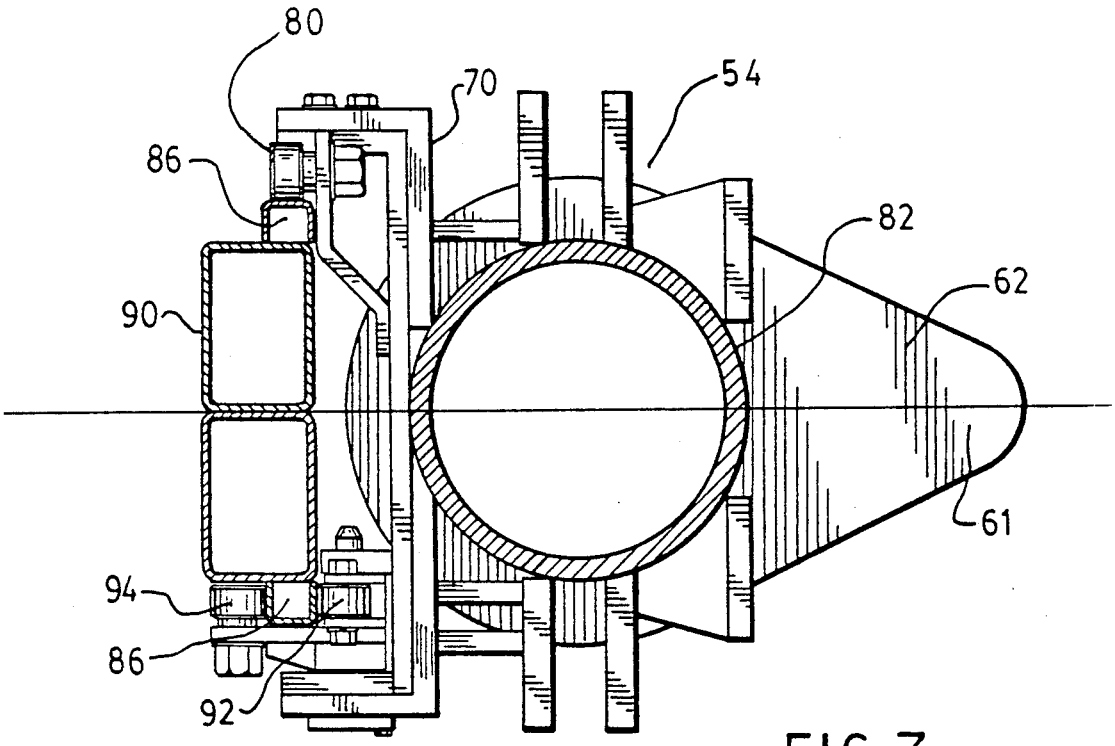
FIG. 7 is a plan view of a top drive with a variation of the means for mounting same to the torque guide.

FIG. 7 illustrates the same top drive in which the carriage is modified. Although the rollers 80 which restrain sideways movement and run on the outside surfaces of the track are illustrated as shown in FIG. 5, this version does not have the guide runners but instead has front and rear rollers 92 and 94 respectively to restrain forward and rearward movement.

Figure 8:
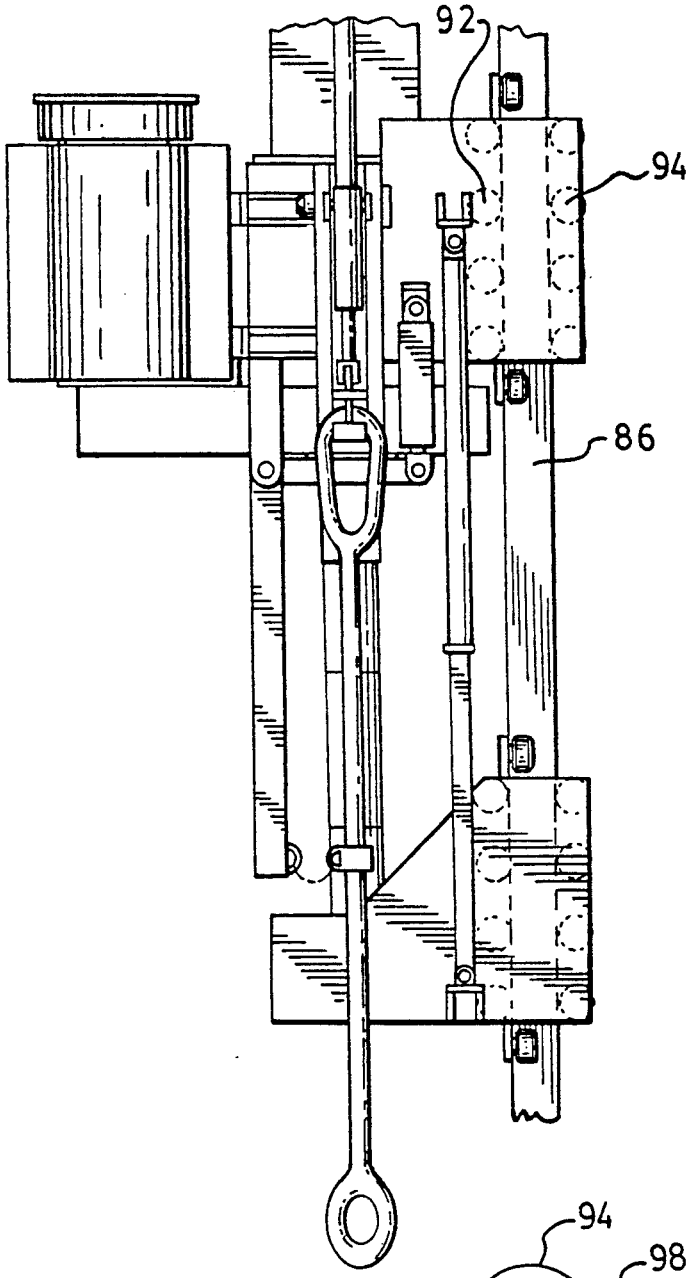
FIG. 8 is an elevation view of the carriage in FIG. 7.
Figure 9:
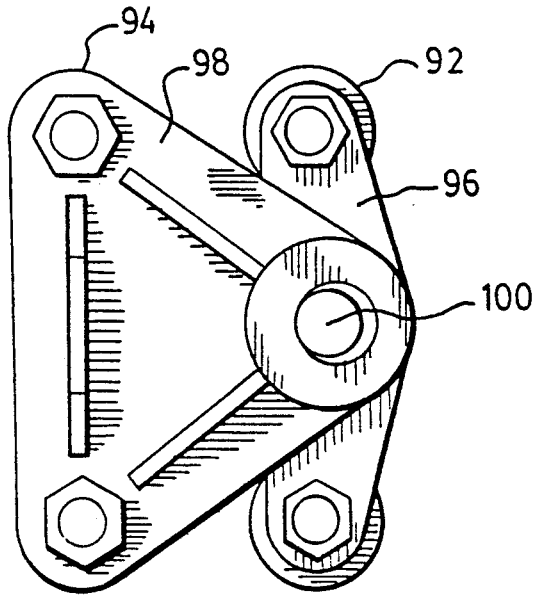
FIG. 9 is a view of the carriage roller chassis.

This form of mounting is illustrated in FIG. 8. Although the particular means by which the guide runners or guide rollers are mounted is not central to this invention, it is preferable that they be provided with means to adjust the tolerance or play between the rollers and the guide track. FIG. 9 illustrates an embodiment of such means in which the forward guide rollers 92 and the rearward guide rollers 94 are mounted to frames 96 and 98 respectively, which are joined by a common pin 100, which has an eccentric or offset centre line so that the spacing between the rollers and the tolerance between the rollers and the track 86 may be adjusted.

Figure 10:
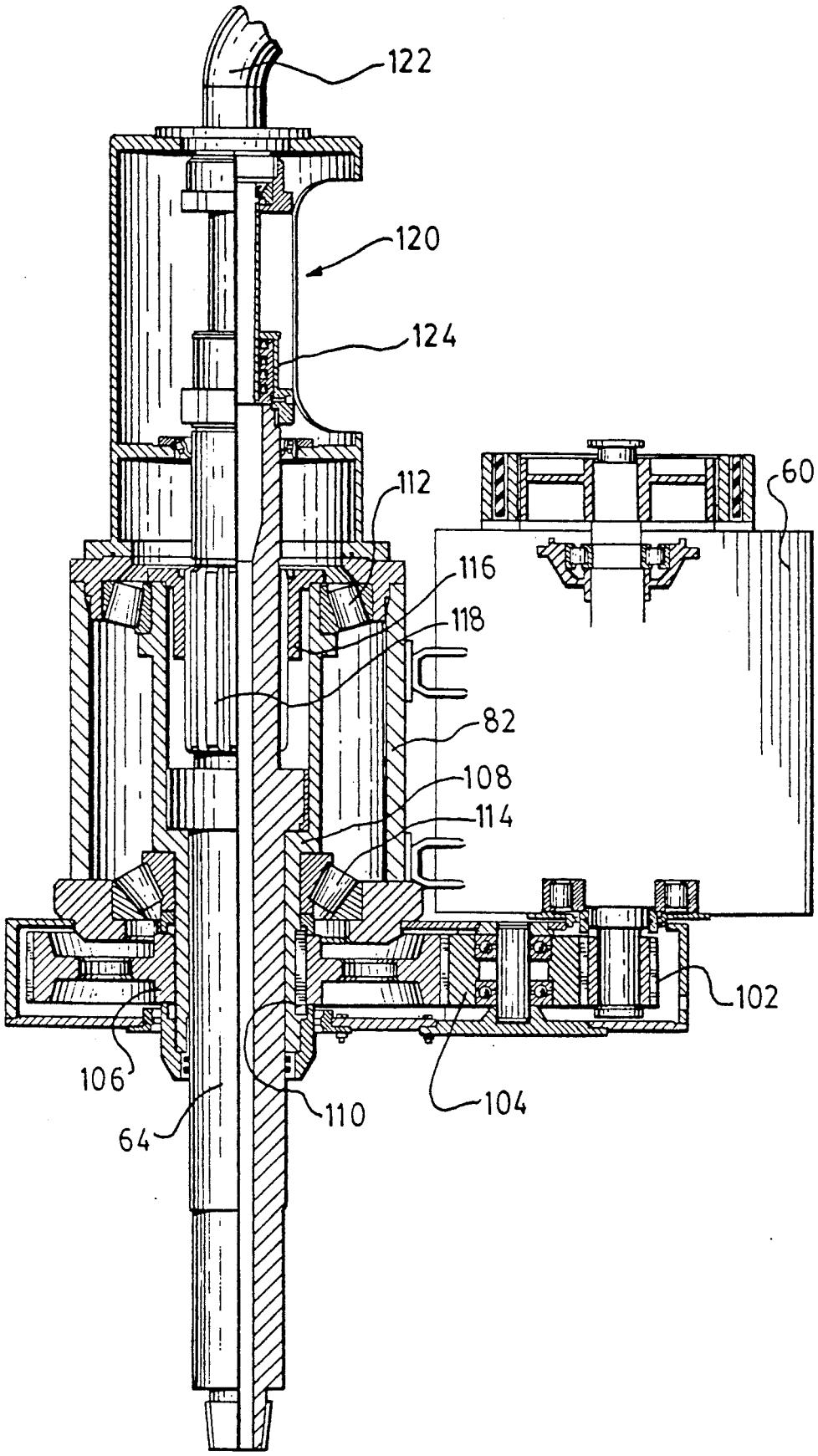
FIG. 10 is a cross-sectional view of the torque drive.

FIG. 10 is a vertical cross-section illustrating the rotational mechanism of the top drive in which the electric motor 60, illustrated in outline, drives a pinion gear 102, which drives an idler gear 104, which drives a bull gear 106. The bull gear is locked to the spindle 108 by the key 110 and the spindle is mounted within the spindle housing 82 (previously referred to in FIGS. 6 and 7). The spindle is mounted to rotate on tapered upper and lower bearings 112 and 114 adapted to handle axial or thrust loads.

The spindle is locked by means of the female drive spline 116 to male spline 118 of the quill 64 shown in FIG. 4.

Thus the motor through the gear arrangement and splines is adapted to rotate the quill 64 in either of the clockwise or counterclockwise direction to permit the quill to be threaded into the drill string (or more commonly into a kelly cock and a saver sub illustrated in FIG. 4 so as to connect to the drill string or to breakout stands of the drill string or to rotate the drill string while drilling.

The fact that the female spline 116 is shorter than the male spline 118 permits vertical movement of the quill (referred to as a "floating quill") which will accommodate some vertical movement while the threads at the end of the quill or in the drill string are being made up.

Above the quill, as shown in FIG. 10, is an internal swivel by which the mud line 122 which is not rotatable, is connected to the rotating quill with the aid of the seals 124 so as to provide a fluid connection whereby the drilling mud (which circulates the cuttings out of the hole) can be pumped through the mud line, through the swivel, and through the interior bore of the quill and down the internal bore of the drill pipe to the bottom of the hole.

For purposes of illustration let us assume that the rig is drilling ahead in the position illustrated in FIG. 3 until the top of the drill string and the top drive reach the derrick floor. At this point additional lengths of drill pipe are needed but because there is no kelly or rotary table it is possible to add a three joint stand of pipe at one time, instead of a single joint.

The drill string is suspended in slips at the drill floor and the too drive is used to spin out the quill (with the kelly cock and saver sub, if any). The travelling block is raised and the elevators used to lift the three joint stand and stab it into the box end of the drill string just above the derrick floor. This connection is made up at the same time as the quill is reconnected to the top of the new stand and drilling can resume and continue uninterrupted for another ninety feet approximately without the need to make a connection every thirty feet as required with a kelly and rotary table of a conventional rig.

The top drive arrangement illustrated and described above has numerous advantages over conventional rigs or previous top drive designs.

By eliminating the conventional hook and mounting the top drive by means of the block adapter 50 and the hangers 52, the vertical dimension of the apparatus illustrated in FIGS. 4 and 5 is substantially reduced. This makes it possible to deal with ninety foot stands of drill pipe within the head room available in a smaller conventional mobile land-type rig where the distance to the crown block is in the order of one hundred and twenty-seven feet.

The hook had previously been considered necessary because it was spring loaded and hydraulically damped to accommodate the vertical movement during the make up of a threaded joint and to reduce thread wear by balancing the weight of the stand while spinning in or out.

In the rig of the present invention the hook is eliminated to provide more head room and the vertical movement during the make up of the threads is accommodated by the floating quill for drilling and reaming operations, and by the spring loaded elevator links 142 for the tripping operations.

Furthermore, the elevator links are provided with a hinged connection 144. This allows the operator to continue drilling after the elevators have reached the level of the derrick floor so that when the drill string is set in the slips there will be a two or three foot sump below the level of the bit which is considered desirable to avoid the tendency of the bit to become stuck near the bottom of the hole.

The design of the built in swivel also contributes to the compactness of the top drive arrangement.

Beneath the quill 64, as previously mentioned, it is considered desirable to mount a kelly cock in which a valve is located to prevent the flow of mud from the quill when it is disconnected from the drill string and the elevators are being raised or lowered. Beneath the kelly cock it is common to have a saver sub which accepts the wear and tear of repeated connection with and disconnection from the drill string, thus avoiding damage to expensive parts such as the quill or kelly cock.

One additional feature provided and illustrated in FIG. 5 is a pivot arm 146 activated by a cylinder 148 and connected by a chain at its lower end to the elevator links 56. By means of this mechanism the elevator links may be swung forward to a position in the front of the mast where they can pick up a new joint of stand pipe from the mouse hole or the monkey board.

In addition, the present invention eliminates some mechanism which provide for the rotation of the elevators (and hence the rest of the top drive's pipe handling mechanism since the elevators are preferably hung high up on the structure) to allow the elevators to face different directions. However, for purposes of smaller land type rigs, most features such as the mouse hole or racks of drill pipe are accessible through the front opening of the mast. Therefor rotatable elevators are considered unnecessary.

While the foregoing design features permit the installation of a top drive in the limited head room of a smaller land type rig, the problem of resisting the reactionary torque induced by the top drive remains. For many smaller rigs with light weight masts the mounting of a track on the structure of the mast is unacceptable. Adding strength to the mast by additional structure makes it heavier and more costly for conversion of existing rigs and undesirable from that standpoint.

The present invention provides a means of accommodating the innovation of a top drive by introducing a separate structure to resist the rotational forces independent of the mast structure. By designing a torque guide mounted on the heavy beams of the substructure of the rig and having a substantial lateral dimension, the torsional forces can be effectively handled without redesigning the mast or modifying a mast of an existing rig.

In one variation of the present invention it is considered advantageous to provide a disengagable connection in the length of the torque guide approximately eight to twelve feet above the floor. This would permit the top drive to be mounted on the short lower end of the torque tube for transportation, thus removing the additional weight of the top drive mechanism from the mast during dismantling and moving operations. The remainder of the torque guide would remain fastened to the mast structure where it would add some rigidity which is desirable to withstand the high forces encountered during the operation of raising and lowering the mast for transportation.

The relatively compact vertical dimension of the top drive design make it easier to transport, as described above, without being too tall for highway overpasses, etc.

As previously mentioned, the bottom end of the torque guide may be fastened to the A frame or other strong structural parts of the base of the rig so long as they are capable of absorbing the reactionary rotational forces of the torque guide so that these forces are not transmitted to the upper regions of the mast. It may also be possible, or even desirable, to provide a connection at the bottom of the torque guide whereby the connection to the floor or sub-structure of the rig is offset rearwardly one or two feet to provide more clearance space at the rig floor.

Thus, by means of the present invention, land-type drilling rigs with limited head room may be converted to the use of top drive mechanisms with all the advantages that flow from that type of system within the confines of the head room available in that type of rig. Furthermore, the need to resist the rotational forces created by the top drive can be handled without putting unacceptable stress on the existing masts or redesigning or restructuring them to handle these forces.

Furthermore, because the lateral position of the centre line of the top drive is controlled by the carriage 38 which is constrained by the widely spaced guides 86, the guide structure will serve to locate the top drive and the quill in line with the drill string and will easily resist tendencies to drift laterally out of alignment as it might if it were merely suspended by the travelling block.

Unlike the slender shaft disclosed in U.S. Pat. No. 2,998,084, or the parallel linkage in U.S. Pat. No. 4,865,135, the present arrangement provides a structural triangle between the centre line of the top drive and the points of resistance at either side of the torque guide so that the lateral positioning of the quill in line with the drill string is easily established and maintained during make up and break out operations, and a substantial resistance to torsional forces is also provided without subjecting the mast to additional stress.

It will, of course, be realized that the details of the embodiments described herein may be varied or modified without departing from the basic principles of the present invention.

I claim:

1. In a drilling rig having a base, mast, crown block, travelling block, means to move said travelling block vertically in said mast, means to support a drill string from said travelling block, and top drive means to rotate said drill string, the improvement comprising:

guide means to control lateral and rotational forces on said top drive;

said guide means comprising a carriage attached to said top drive for vertical movement therewith;

a torque guide comprising a vertical hollow shaft having spaced apart front, rear, and side faces;

said side faces each having a track means to guide said carriage therealong and permit vertical movement while providing restraint against lateral or rotational forces on said carriage from said top drive;

said torque guide being mounted to said rig base and having sufficient torsional rigidity to resist said lateral and rotational forces without support from said mast;

said track means being spaced apart so that the distance between track means is approximately the same order of magnitude as the distance between a track means and the drill string.

2. The invention as claimed in claim 1 in which said torque guide is mounted to said mast at spaced intervals therealong sufficient to maintain its vertical position.

3. The invention as claimed in claim 1 in which the lateral position of said top drive is maintained by a rigid connection of said top drive to said carriage.

4. The invention as claimed in claim 2 in which the lateral position of said top drive is maintained by a rigid connection of said top drive to said carriage.

5. The invention as claimed in claim 1 in which the spacing between the top drive and each of said track means remains constant.

6. The invention as claimed in claim 2 in which the spacing between the top drive and each of said track means remains constant.

7. The invention as claimed in claim 3 in which the spacing between the top drive and each of said track means remains constant.

8. The invention as claimed in claim 4 in which the spacing between the top drive and each of said track means remains constant.

9. The invention as claimed in claim 1 in which torsional forces transmitted to said torque guide are restrained by means of the connection between said torque guide and said rig base.

10. The invention as claimed in claim 2 in which torsional forces transmitted to said torque guide are restrained by means of the connection between said torque guide and said rig base.

11. The invention as claimed in claim 3 in which torsional forces transmitted to said torque guide are restrained by means of the connection between said torque guide and said rig base.

12. The invention as claimed in claim 4 in which torsional forces transmitted to said torque guide are restrained by means of the connection between said torque guide and said rig base.

13. The invention as claimed in claim 5 in which torsional forces transmitted to said torque guide are restrained by means of the connection between said torque guide and said rig base.

14. The invention as claimed in claim 6 in which torsional forces transmitted to said torque guide are restrained by means of the connection between said torque guide and said rig base.

15. The invention as claimed in claim 7 in which torsional forces transmitted to said torque guide are restrained by means of the connection between said torque guide and said rig base.

16. The invention as claimed in claim 8 in which torsional forces transmitted to said torque guide are restrained by means of the connection between said torque guide and said rig base.

17. In a top drive for use in rotating a drill string in a drilling rig having a base, mast, crown block, travelling block, means to move said travelling block vertically in said mast, and means to support a drill string from said travelling block, the improvement comprising:

guide means to control lateral and rotational forces on said top drive;

said guide means comprising a carriage attached to said top drive for vertical movement therewith;

a torque guide comprising a vertical hollow shaft having spaced apart front, rear, and side faces;

said side faces each having a track means to guide said carriage therealong and permit vertical movement while providing restraint against lateral or rotational forces on said carriage from said top drive;

said torque guide being mounted to said rig base and having sufficient torsional rigidity to resist said lateral and rotational forces; and said track means being spaced apart so that the distance between said track means is approximately the same order of magnitude as the distance between a track means and the drill string.

* * * * *